US006890287B2

(12) United States Patent
Chen

(10) Patent No.: US 6,890,287 B2
(45) Date of Patent: May 10, 2005

(54) COLLAPSIBLE TREADMILL CAPABLE OF BEING AUTOMATICALLY SECURED TO A COLLAPSED POSITION

(76) Inventor: Chao-Chuan Chen, No. 15, Lane 9, Chin Jung Village, U Feng Hsian, Taichung Hsien (TW)

( * ) Notice: Subject to any disclaimer, the term of this patent is extended or adjusted under 35 U.S.C. 154(b) by 58 days.

(21) Appl. No.: 10/663,651

(22) Filed: Sep. 17, 2003

(65) Prior Publication Data

US 2005/0009667 A1 Jan. 13, 2005

(30) Foreign Application Priority Data

Jul. 9, 2003 (TW) ..... 92212601 U

(51) Int. Cl.[7] ..... A63B 22/02
(52) U.S. Cl. ..... 482/54
(58) Field of Search ..... 482/51, 54

(56) References Cited

U.S. PATENT DOCUMENTS 6,090,016 A * 7/2000 Kuo ..... 482/54
6,213,919 B1 * 4/2001 Wang et al. ..... 482/54
6,261,209 B1 * 7/2001 Coody ..... 482/54
2004/0132585 A1 * 7/2004 Chen

FOREIGN PATENT DOCUMENTS

TW 395263 6/2000
TW 472595 1/2002

* cited by examiner

*Primary Examiner*—Justine R. Yu
*Assistant Examiner*—Tam Nguyen
(74) *Attorney, Agent, or Firm*—Browdy and Neimark, P.L.L.C.

(57) ABSTRACT

A collapsible treadmill includes a base, a treadbase pivotably mounted on the base, a retractable member having a cylinder and a bar fitted into cylinder. The cylinder is pivotably mounted on the base at an end thereof. The bar is pivotably mounted on the treadbase. A sleeve is fitted onto the cylinder and pivotably mounted on the treadbase together coaxially with the bar. A locking member is pivotably mounted on the sleeve and has a stop lug to be inserted into a stop slot of the sleeve. A biasing member keeps the stop lug of the locking member inserted into the stop slot and engaged against an outer periphery of the cylinder. When the treadbase is at a collapsed position, the locking member can be driven to engage against a distal end surface of the cylinder, thereby automatically securing the treadbase to the collapsed position.

10 Claims, 8 Drawing Sheets

COLLAPSIBLE TREADMILL CAPABLE OF BEING AUTOMATICALLY SECURED TO A COLLAPSED POSITION

BACKGROUND OF THE INVENTION

1. Field of the Invention

The present invention relates generally to treadmills, and more particularly, to a collapsible treadmill capable of being automatically secured to a collapsed position while at the collapsed position.

2. Description of the Related Art

A conventional treadmill is composed of a base and a treadbase pivotably mounted on the base to enable the treadbase to pivot relative to the base between a horizontal operative position and an upright or slantingly standing collapsed position such that the required space occupied by the treadmill can be reduced when the treadmill is not in use.

The aforesaid treadmill must have a positioning device for securing the treadbase to a collapsed position. For example, Taiwan Utility Model Publication Nos. 472595 and 395263 disclosed that the treadbase would be automatically secured to a collapsed position while the treadmill is at the collapsed position.

The treadmill disclosed in Taiwan Utility Model Publication No. 472595 is primarily composed of a base, a treadbase, a retractable bar assembly, and a stopping member. The retractable bar assembly includes a cylinder and a bar respectively pivotably connected with the treadbase and the base. The stopping member is pivotably mounted on the base at an end thereof together coaxially with the bar. The stopping member will be automatically inclined by means of the gravity while the treadmill is at a collapsed position so as to engage against an end surface of the cylinder, thereby securing the treadbase to the collapsed position. However, this conventional treadmill is unsafe, i.e. the stopping member is too large-sized, and no available mechanical power is provided to maintain the engagement of the stopping member to the end surface of the cylinder, such that it's easy for the user to touch the stopping member carelessly and to further cause the stopping member to run away from where the stopping member engages against the end surface of the cylinder, thereby causing the treadbase to topple down.

The treadmill disclosed in Taiwan Utility Model Publication No. 395263 is primarily composed of a base, a treadbase, a pneumatic cylinder, a support piece, and a torsion spring. The pneumatic cylinder includes a cylinder and a bar respectively pivotably connected with the base and the treadbase. The support piece, the torsion spring, and the bar are coaxially pivotably connected to the treadbase. While the treadbase is at a collapsed position, the support piece will automatically engage against the end surface of the cylinder by means of the resilience generated by the spring so as to secure the treadbase to the collapsed position and meanwhile to keep the support piece engaging against the end surface of the cylinder by the spring. Although the torsion spring can keep the support piece engaging against the end surface of the cylinder, the support piece is still too large-sized such that it's easy for the user to touch the stopping member carelessly so as to cause the support piece to run away from where the support piece engages against the end surface of the cylinder and to further cause the treadbase to topple down. Hence, such kind of treadmill is still unsafe.

SUMMARY OF THE INVENTION

The primary objective of the present invention is to provide a collapsible treadmill capable of being automatically secured to a collapsed position while at the collapsed position, which is preferably safe.

The foregoing objective of the present invention is attained by the collapsible treadmill, which is composed of a base; a treadbase pivotably mounted on the base; a retractable member having a cylinder and a bar, the bar having two ends respectively inserted into the cylinder and extended out of the cylinder, the cylinder being pivotably mounted on the base at an end thereof, the bar being pivotably mounted on the treadbase, whereby the bar is slidable inside the cylinder along with the pivoting of the treadbase relatively to the base; a sleeve fitted to the cylinder and pivotably mounted on the treadbase together coaxially with the bar, whereby the sleeve is reciprocatingly slidable relatively to the cylinder along with the pivoting of the treadbase relatively to the base, the sleeve further having a stop slot; a locking member pivotably mounted on the sleeve and having a stop lug to be inserted into the stop slot; and a biasing member for keeping the stop lug of the locking member inserted into the stop slot and engaging against an outer periphery of the cylinder. When the treadbase is at a collapsed position, the locking member can be driven to engage against a distal end surface of the cylinder, thereby automatically securing the treadbase to the collapsed position.

DETAILED DESCRIPTION OF THE INVENTION

Figure 1:
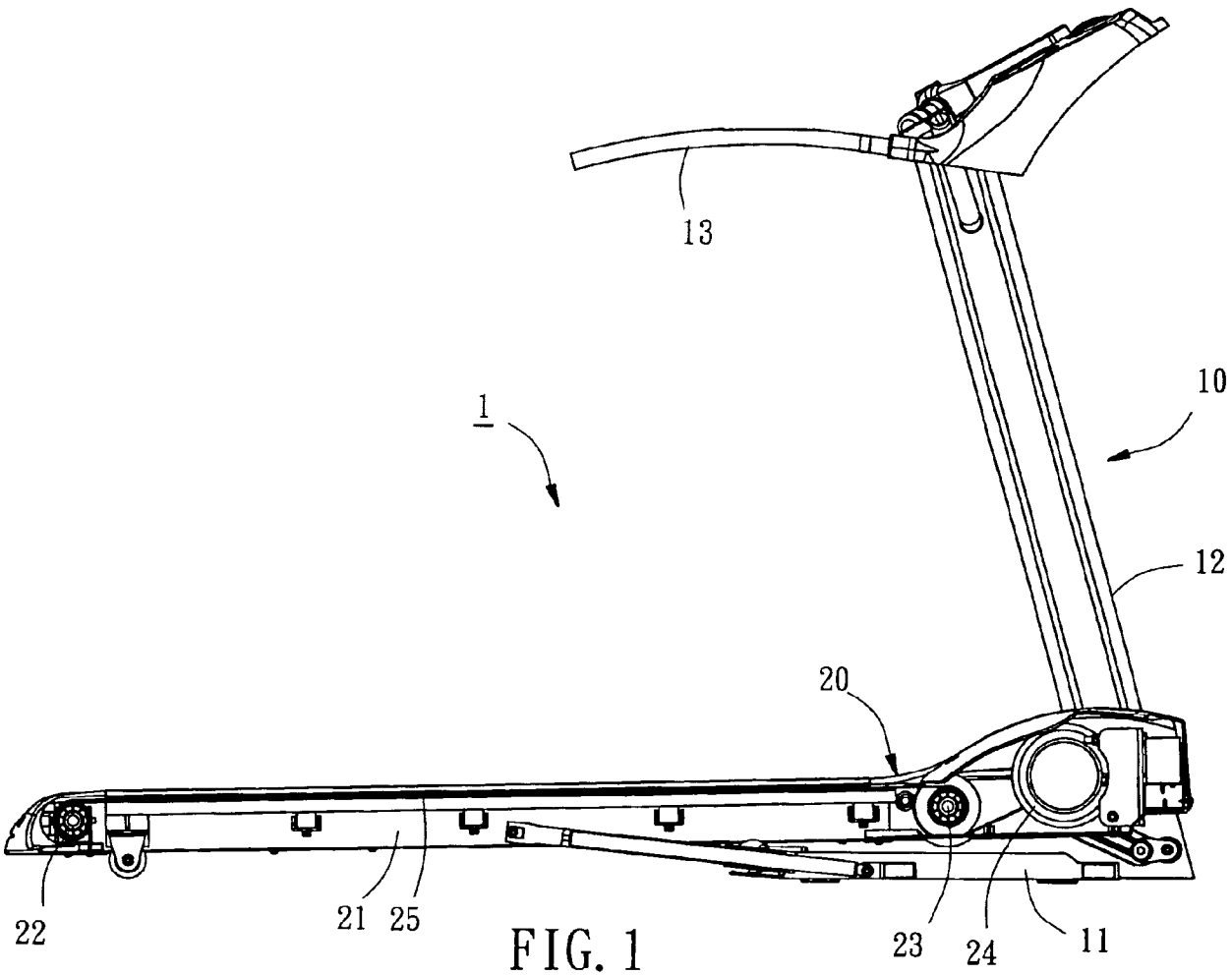
FIG. 1 is a side view of a first preferred embodiment of the present invention.
Figure 2:
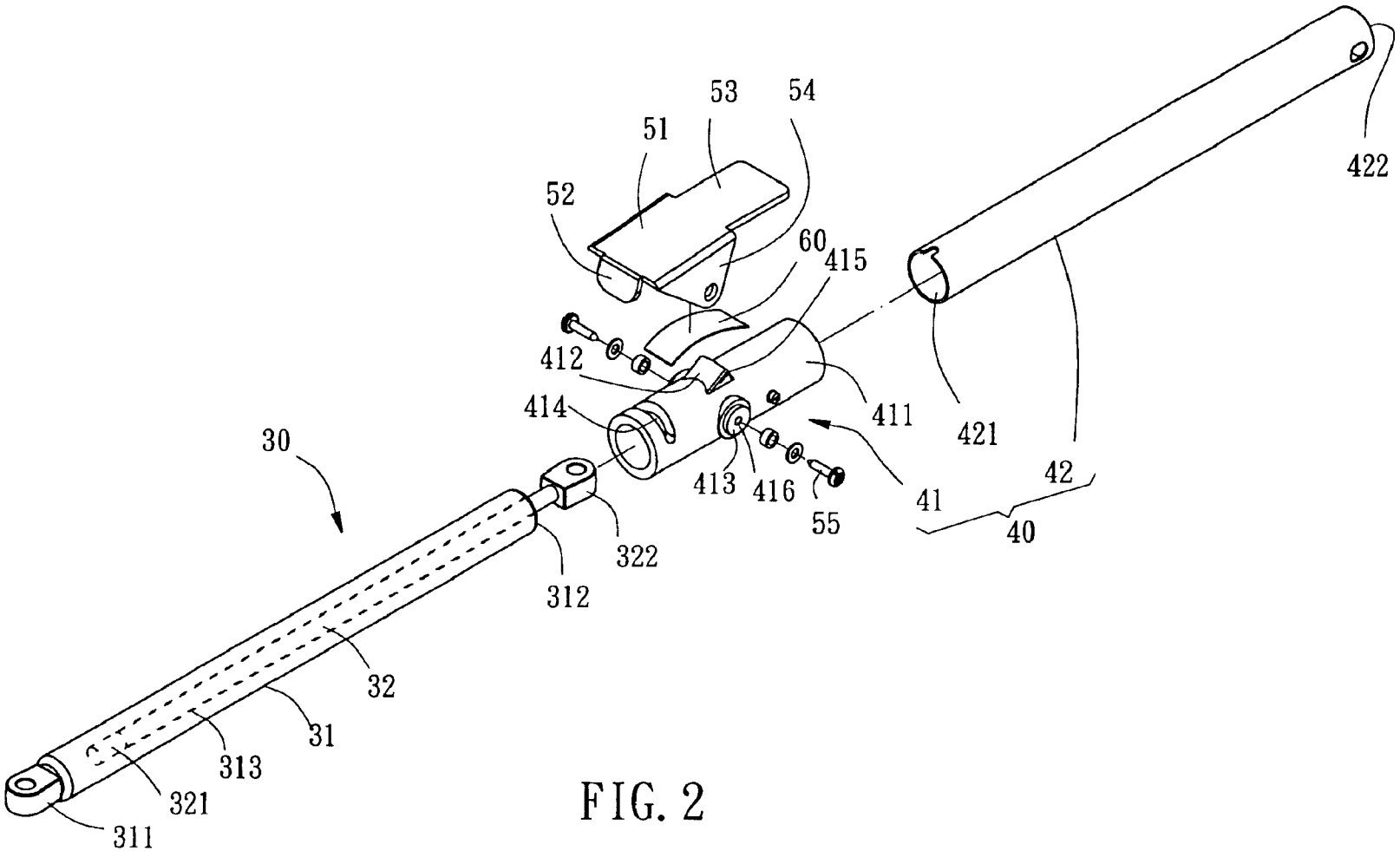
FIG. 2 is a partial exploded view of the first preferred embodiment of the present invention.

Referring to FIGS. 1 and 2, a treadmill 1 constructed according to a first preferred embodiment of the present invention is composed of a base 10, a treadbase 20, a retractable member 30, a sleeve 40, a locking member 50, and a biasing member 60.

The base 10 includes a bottom frame 11, a base frame 12 slantingly mounted on a front side of the bottom frame 11, and a pair of handrails 13 mounted on a top side of the base frame 12.

The treadbase 20 includes a framework 21, a driven roller 22 mounted the framework 21, a driving roller 23, a motor 24, and an endless belt 25 running on the driven roller 22 and the driving roller 23. The framework 21 is pivotably mounted on the bottom frame 11 at a front side thereof to enable the treadbase 20 to pivot reciprocatingly between an operative position, in which the treadbase 20 lies horizontally, and a collapsed position, in which the treadbase 20 lies slantingly.

The retractable member is embodied as a pneumatic damper 30, including a cylinder 31 and a bar 32. The cylinder 31 is provided with a first pivot end 311, a distal end 312, and a cylindrical hole 313 defining an opening at its free end. The first pivot end 311 is coupled to the bottom frame 11. The bar 32 is provided with an interior end 321 and an exterior end 322 respectively inserted into the cylindrical hole 313 and extended through the opening of the cylinder 31, and the exterior end 322 is pivotably mounted on the framework 21. Hence, when the treadbase 20 pivots relatively to the base 10, the bar 32 can be driven to reciprocate along the cylindrical hole 313, whereby the pressure in the cylindrical hole 313 is variated to generate buffer effect while the treadbase 20 pivots. The above operation is well known to the person who is skilled in the art and will not be further described.

The sleeve 40, which length is larger than total amount of displacement that the bar 32 of the pneumatic damper 30 extends and retracts along the cylindrical hole 313, includes a first tube 41 and a second tube 42. The first tube 41 is provided with a tubular member 411, a tongue spring socket 412 protruded from an outer periphery of the tubular member 411, two pivot seats 413 respectively protruded from two symmetrical sides of the outer periphery of the tubular member 411, and a stop slot 414 positioned on the tubular member 411, wherein the tongue spring socket 412 and the stop slot 414 are positioned at the same side of the outer periphery of the tubular member 411, and the two pivot seats 413 are positioned respectively at two lateral sides of the tongue spring socket 412. The tongue spring socket 412 is provided with an insert slot 415 thereon. Each of the two pivot seats 413 is provided with a pivot hole 416. The second tubular member 42 defines an insert end 421 and a second pivot end 422, and is coaxially inserted into the first tubular member 41 at the insert end 421 thereof. The sleeve 40 is fitted onto the cylinder 31. The second pivot end 422 of the second tubular member 42 and the bar 32 are coaxially pivotably mounted to the framework 21. Hence, when the treadbase 20 pivots relatively to the base 10, the sleeve 40 can be driven to reciprocate relatively to the cylinder 31; when the treadbase 20 is at the collapsed position, the stop slot 414 coincides with a position corresponding to a distal end of the cylinder 31.

The locking member 50 includes a rectangular sheet-like main body 51, a protruded sheet-like stop lug 52 extending downwards from an end of the main body 51, an actuating portion 53 extending from the other end of the main body 51, and two triangular pivot lugs 54 extending downwards from bilateral edges of the main body 51. The two pivot lugs 54 are respectively pivotably mounted to the two pivot seats 413 by means of two pivot bolts 55, such that the locking member 50 can pivot between a position, in which the stop lug 52 is inserted into the stop slot 414, and a position, in which the stop lug 52 is disengaged from the stop slot 414.

The biasing member is embodied as a tongue spring 60 and has an end inserted into the insert slot 415 of the tongue spring socket 412 and the other end engaging against a corresponding side of the locking member 50. Hence, the tongue spring 60 generates a resilience to support the locking member 50 and to keep the stop lug 52 inserted into the stop slot 414 and engaging an outer periphery of the cylinder 31 when the treadbase 20 is not at the collapsed position. In addition, when the treadbase 20 is at the collapsed position, the tongue spring 60 can push the locking member 50 to enable the stop lug 52 to engage against the distal end 312 of the cylinder 31.

Figure 3:
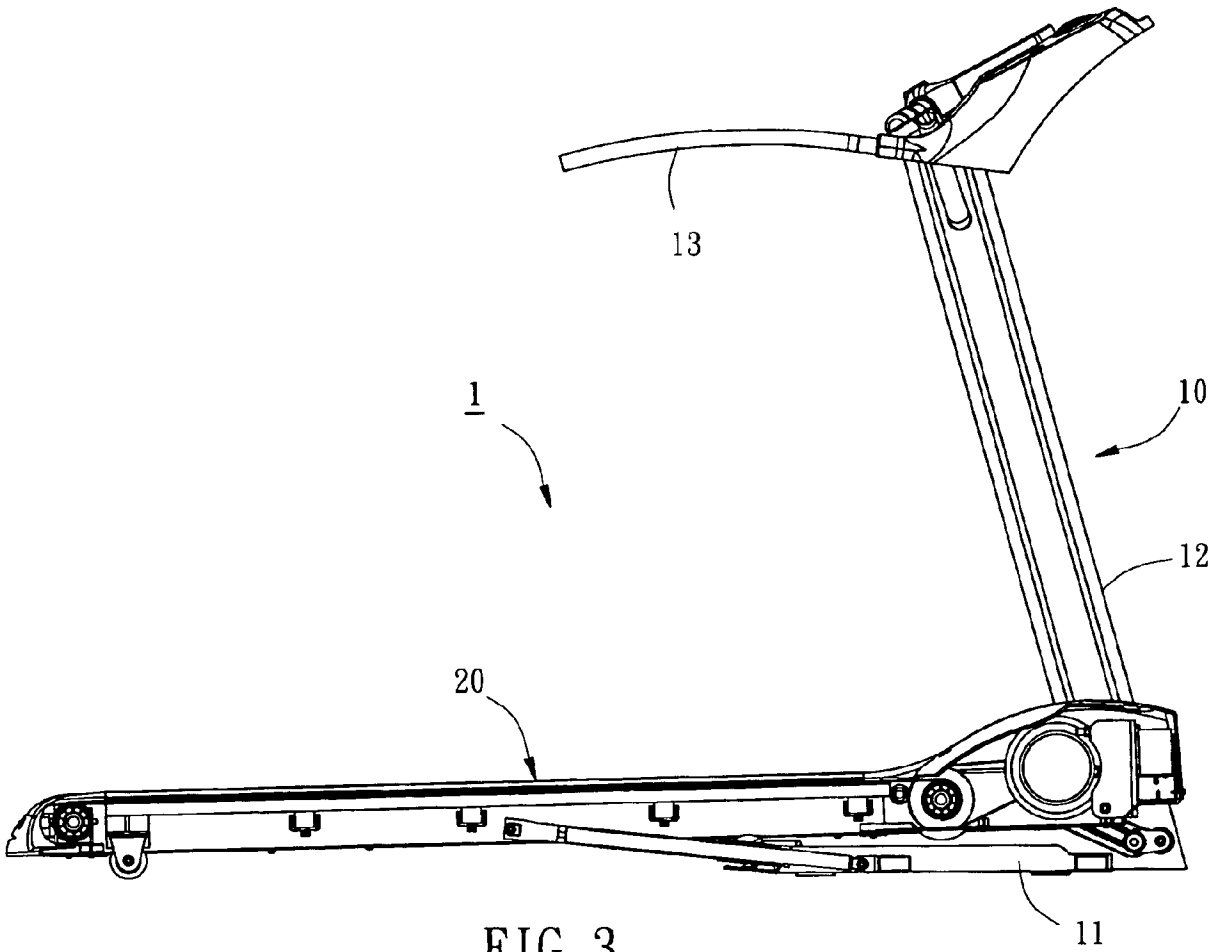
FIGS. 3–6 are schematic views of the first preferred embodiment of the present invention, showing the present invention at work.

Referring to FIGS. 3–6, the treadbase 20 of the treadmill 1 of the first preferred embodiment of the present invention, which is at the operative position, lies on the ground at an angle of elevation. In the meantime, the bar 32 is forced to be retracted inside the cylinder 31 by the treadbase 20, the cylinder 31 is mostly retracted inside the sleeve 40, and the tongue spring 60 forces the stop lug 52 of the locking member 50 to be inserted into the stop slot 414 and to further engage against the outer periphery of the cylinder 31, as shown in FIG. 3. The length of the sleeve 40 is larger than the total amount of displacement that the bar 32 of the pneumatic damper 30 reciprocates along the cylindrical hole 313, such that the sleeve 40 encapsulates the whole outer periphery of the cylinder 31 while the treadbase 20 pivots from the operative position to the collapsed position, thereby enhancing the stability of the collapsing procedure of the treadbase 20.

Figure 4:
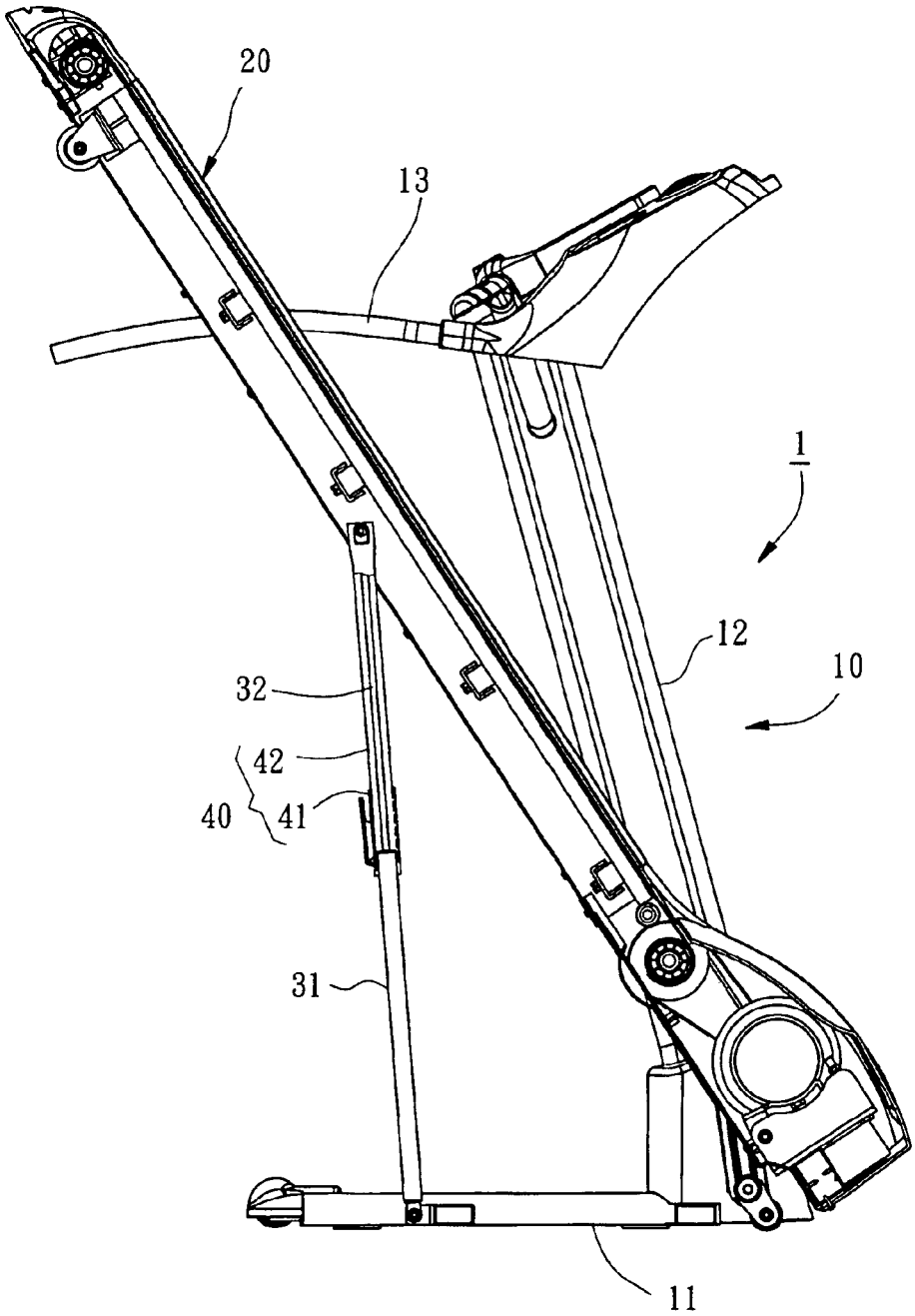

When the user intends to collapse the treadbase 20, it is as easy as raising a free end of the treadbase 20 to enable the treadbase 20 to pivot relatively to the base 10 toward the collapsed position. In the meantime, the bar 32 is gradually pulled outwards by the treadbase 20 to extend out of the cylinder 31, and the cylinder 31 gradually extends out of the sleeve 40, as shown in FIG. 4.

Figure 5:
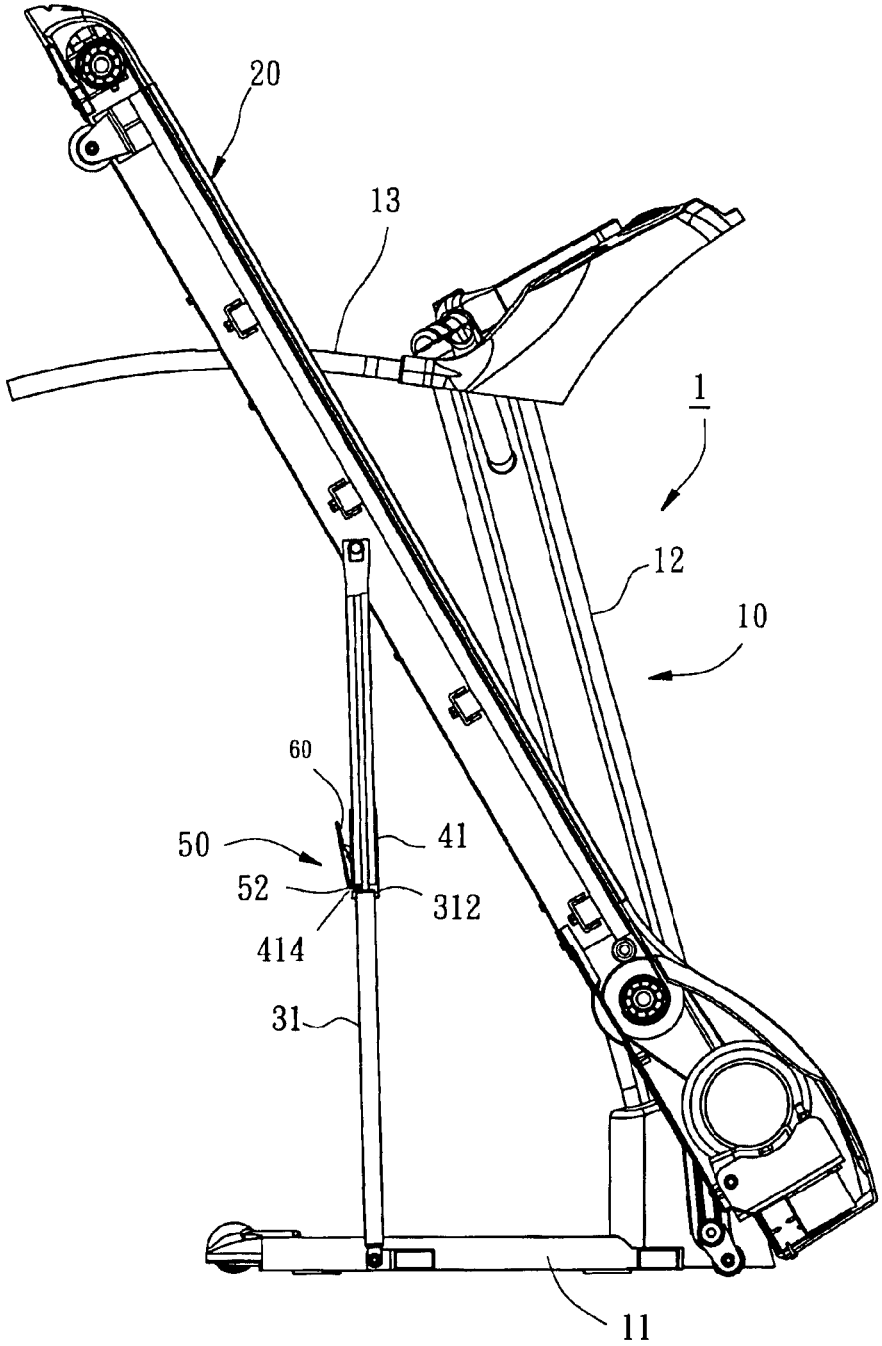

When the treadbase 20 reaches the collapsed position, the stop slot 414 of the first tubular member 41 coincide with the position corresponding to the distal end 312 of the cylinder 31. At the same time, the stop lug 52 of the locking member 50 engages against the distal end 312 of the cylinder 31 by means of the tongue spring 60 to stop the cylinder 31 from being further retracted into the sleeve 40, as shown in FIG. 5. In other words, the treadbase 20 fails to pivotably return to the operative position so as to be automatically secured to the collapsed position.

Figure 6:
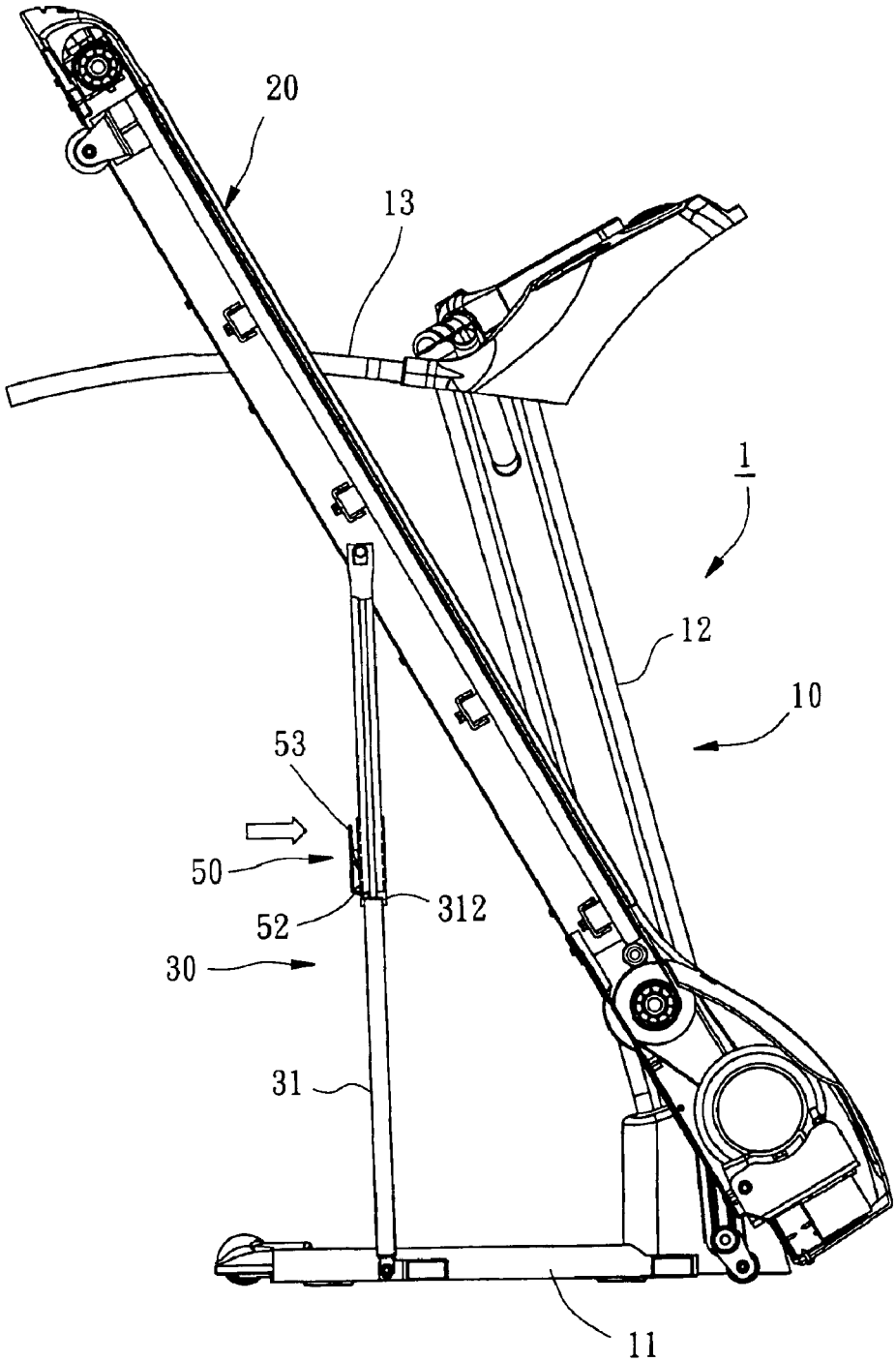

When the user intends to put the treadbase 20 back to the operative position, it's as easy as pressing the actuating portion 53 to enable the stop lug 52 to disengage from the distal end 312 of the cylinder 31, as shown in FIG. 6, and to further enable the treadbase 20 to gradually pivot back to the operative position by the gravity and the resistance generated by the damper 30.

From the above operation, the sleeve 40 is worked to enable the cylinder 31 to stably retract inside thereof and to extend outside thereof. In other words, the sleeve 40 is provided to support the locking member 50 and to enable the locking member 50 to stably slide along the cylinder 31, rather than worked to secure the treadbase 20 to the collapsed position. Hence, even though the user carelessly touches the sleeve 40, the treadbase 20 will not disengage from the collapsed position. In addition, the locking member 50 which can indeed secure the treadbase 20 to the collapsed position is small-sized, such that it's not easy for the user to touch the locking member 50 carelessly, and thereby the treadmill is preferably safe while securing to the collapsed position.

Further, the sleeve 40 is worked to enable the locking member 50 to stably reciprocate along the cylinder 31, such that the locking member 50 can accurately and precisely move to precisely secure the treadbase 20 to the collapsed position.

In addition to the pneumatic damper, the retractable member can alternatively be a hydraulic damper.

Figure 7:
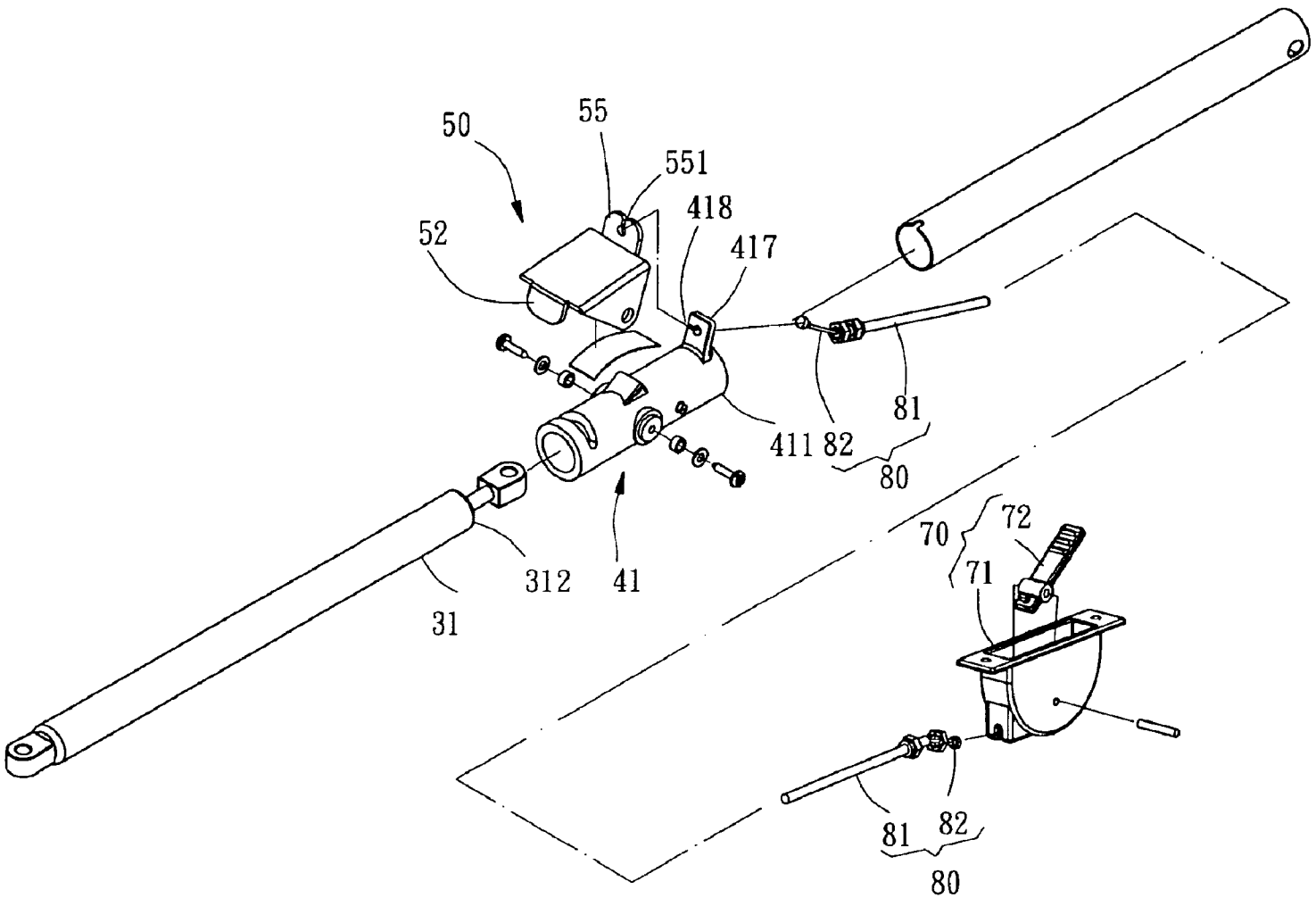
FIG. 7 is a partial exploded view of a second preferred embodiment of the present invention.

Referring to FIG. 7, which shows a second preferred embodiment of the present invention, the difference between the second preferred embodiment and the first preferred embodiment is specified as follows. The first tubular member 41 is further provided with a junction mount 417 protruded from the first tube 411, wherein the junction mount 417 has a junction hole 418 thereon. The actuating portion 55 of the locking member 50 extends upwards from the main body and has a through hole 551. The treadmill further includes a switch 70 and a draw cord 80, wherein the switch 70 is fixedly mounted on the base 10 and is provided with a switch body 71 and a control draw link 72 pivotably mounted on the switch body 71. The draw cord 80 is provided with a cord sleeve 81 and a cord body 82, wherein the cord body 82 is inserted into the cord sleeve 81 and extends out of two distal ends of the cord sleeve 81 respectively at two free ends thereof. The cord body 82 is connected with the switch body 71 and the junction mount 417 respectively at the two free ends thereof. The cord sleeve 81 is connected with the control draw link 72 and the actuating portion 55 respectively at the two free ends thereof. Hence, it's as easy for the user as drawing the control draw link 72 to enable the cord body 82 to activate the locking member 50 and to further force the stop lug 52 to disengage from the distal end of the cylinder 31, thereby unlocking the treadbase away from the collapsed position.

Hence, the treadmill of the second preferred embodiment of the present invention is more convenient, and the locking member 50 is more small-sized, such that the user will hardly carelessly touch the locking member 50 and thereby the treadmill is preferably safe.

Figure 8:
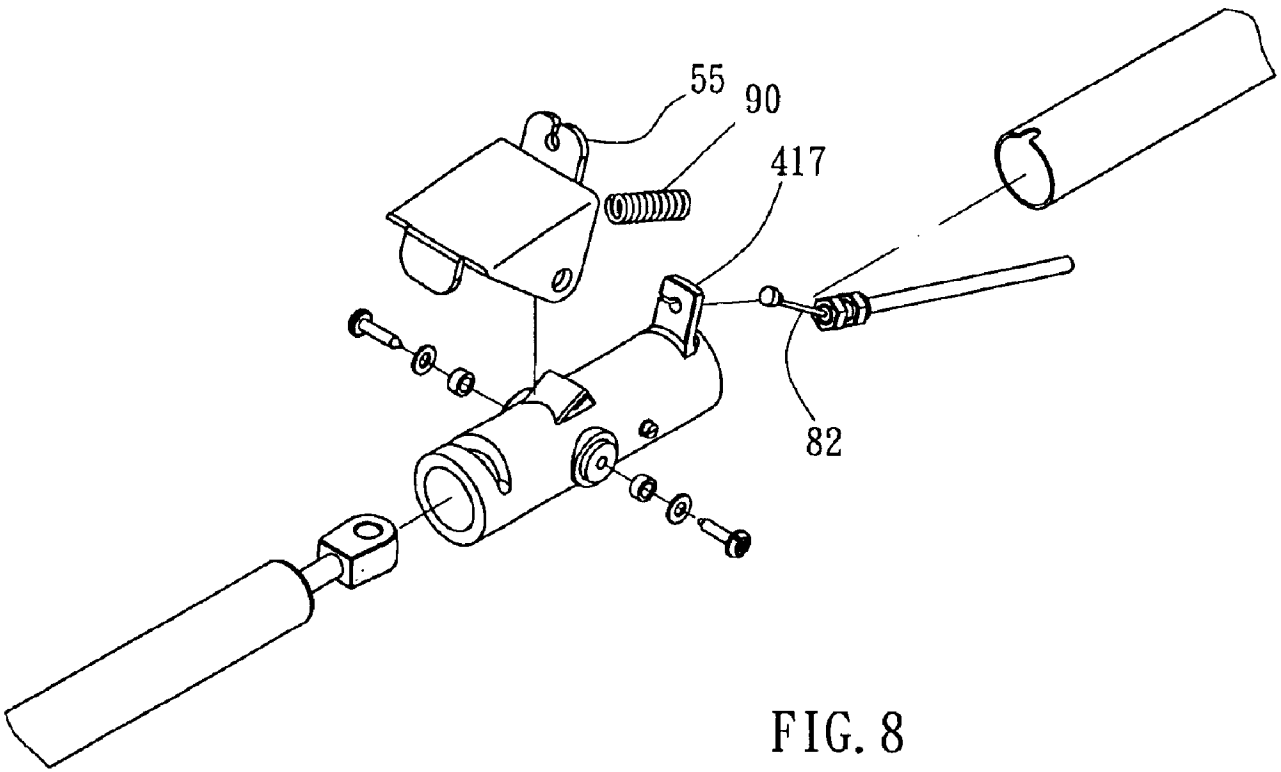
FIG. 8 is a partial exploded view of a third preferred embodiment of the present invention.

Referring to FIG. 8, which shows a third preferred embodiment of the present invention, the difference between the third preferred embodiment and the first preferred embodiment lies in that the biasing member is a compression spring 90, is fitted onto the cord body 82, and positioned between the junction mount 417 and the actuating portion 55 of the locking member 50.

What is claimed is:

1. A collapsible treadmill capable of being automatically secured to a collapsed position, said treadmill comprising:

a base;

a treadbase pivotably mounted on said base to pivot relatively to said base between an operative position and the collapsed position;

a damper having a cylinder and a bar, said cylinder defining a first pivot end and a distal end at two ends thereof and provided with a cylindrical hole inside, said cylindrical hole defining an opening at a free end thereof, said bar defining an interior end for inserted into said cylindrical hole and an exterior end for extending out of said opening of said cylinder at two ends thereof, whereby said bar reciprocates along said cylindrical hole, said cylinder being pivotably mounted to said base at the first pivot end thereof, said bar being pivotably mounted to said treadbase at the exterior end thereof;

a sleeve fitted onto said cylinder to reciprocate along the cylinder, an end of said sleeve and the exterior end of said bar being coaxially pivotably mounted to said treadbase respectively, whereby said treadbase drives said sleeve to reciprocate relatively to said cylinder while said treadbase pivots relatively to said base, said sleeve having a stop slot thereon coinciding with a position corresponding to the distal end of said cylinder while said treadbase is at the collapsed position;

a locking member pivotably mounted on said sleeve and having a stop lug to be inserted into said stop slot; and a biasing member for providing a resilience to keep said stop lug of said locking member inserted into said stop slot and engaging against an outer periphery of said cylinder while said treadbase is not at the collapsed position and to push said locking member to enable said stop lug to engage against the distal end of said cylinder while said treadbase is at the collapsed position.

2. The treadmill as defined in claim 1, wherein said retractable member is a pneumatic/hydraulic damper.

3. The treadmill as defined in claim 1, wherein said sleeve comprises a first tube and a second tube, said second tube defining an insert end for coaxially inserted into said first tube and a second pivot end for pivotably mounted to said treadbase together coaxially with said bar.

4. The treadmill as defined in claim 3, wherein said first tube comprises a tubular member, a tongue spring socket protruded from an outer periphery of said tubular member, two pivot seats protruded respectively from two symmetrical sides of the outer periphery of said tubular member, and the stop slot positioned on said tubular member; wherein said tongue spring socket and said stop slot are positioned at the same side of the outer periphery of said tubular member, and said two pivot seats are respectively positioned at two lateral sides of said tongue spring socket, said tongue spring socket having an insert slot; wherein said locking member comprises a main body, said stop lug extending downwards from an end of said main body, and two triangular pivot lugs extending downwards from bilateral edges of said main body, said two pivot lugs being pivotably mounted to said two pivot seats by means of two pivot bolts to enable said locking member to pivot above said first tube between a position where said stop lug is inserted into said stop slot and a position where said stop lug disengages from said stop slot; wherein said biasing member is a tongue spring and has an end inserted into said insert slot of said tongue spring socket and the other end engaging against a corresponding side of said main body.

5. The treadmill as defined in claim 4, wherein said first tube further comprises a junction mount protruded from said tubular member; said locking member further comprises an actuating portion extending upwards from said main body; said treadmill further comprises a switch and a draw cord, said switch being fixedly mounted on said base and having a switch body and a control draw link pivotably mounted on said switch body, said draw cord having a cord sleeve and a cord body inserted into said cord sleeve and extending out of two ends of said sleeve respectively at two ends thereof, said cord sleeve having two ends respectively connected with said switch body and said junction mount, said cord body being connected with said control draw link and said actuating portion.

6. The treadmill as defined in claim 3, wherein said first tube comprises a tubular member, a junction mount protruded from said tubular member, two pivot seats protruded respectively from two symmetrical sides of the outer periphery of said tubular member, and the stop slot positioned on said tubular member; said locking member comprises a main body, said stop lug extending downwards from an end of said main body, an actuating portion extending upwards from the other end of said main body, and two triangular pivot lugs extending downwards from bilateral edges of said main body, said two pivot lugs being pivotably mounted to said two pivot seats by means of two pivot bolts to enable said locking member to pivot above said first tube between a position where said stop lug is inserted into said stop slot and a position where said stop lug disengages from said stop slot; said treadmill further comprises a switch and a draw cord, said switch being mounted on said base and having a switch body and a control draw link pivotably mounted on said switch body, said draw cord having a cord sleeve and a cord body inserted into said cord sleeve and extending out of two ends of said sleeve respectively at two ends thereof, said cord sleeve having two ends respectively connected with said switch body and said junction mount, said cord body being connected with said control draw link and said actuating portion; said biasing member is a compression spring, fitted onto said cord body, and positioned between said junction mount and said actuating portion of said locking member.

7. The treadmill as defined in claim 1, wherein said sleeve comprises a tubular member, a tongue spring socket protruded from an outer periphery of said tubular member, two pivot seats protruded respectively from two symmetrical sides of the outer periphery of said tubular member, and the stop slot positioned on said tubular member; wherein said tongue spring socket and said stop slot are positioned at the same side of the outer periphery of said tubular member, and said two pivot seats are respectively positioned at two lateral sides of said tongue spring socket, said tongue spring socket having an insert slot; said locking member comprises a main body, said stop lug extending downwards from an end of said main body, and two triangular pivot lugs extending downwards from bilateral edges of said main body, said two pivot lugs being pivotably mounted to said two pivot seats by means of two pivot bolts to enable said locking member to pivot above said sleeve between a position where said stop lug is inserted into said stop slot and a position where said stop lug disengages from said stop slot; said biasing member is a tongue spring and has an end inserted into said insert slot of said tongue spring socket and the other end engaging against a corresponding side of said main body.

8. The treadmill as defined in claim 7, wherein said sleeve further comprises a junction mount protruded from said tubular member; sad locking member further comprises an actuating portion extending upwards from said main body; said treadmill further comprises a switch and a draw cord, said switch being fixedly mounted on said base and having a switch body and a control draw link pivotably mounted on said switch body, said draw cord having a cord sleeve and a cord body inserted into said cord sleeve and extending out of two ends of said sleeve respectively at two ends thereof, said cord sleeve having two ends respectively connected with said switch body and said junction mount, said cord body being connected with said control draw link and said actuating portion.

9. The treadmill as defined in claim 1, wherein said sleeve comprises a tubular member, a junction mount protruded from said tubular member, two pivot seats protruded respectively from two symmetrical sides of the outer periphery of said tubular member, and the stop slot positioned on said tubular member; said locking member comprises a main body, said stop lug extending downwards from an end of said main body, an actuating portion extending upwards from the other end of said main body, and two triangular pivot lugs extending downwards from bilateral edges of said main body, said two pivot lugs being pivotably mounted to said two pivot seats by means of two pivot bolts to enable said locking member to pivot above said sleeve between a position where said stop lug is inserted into said stop slot and a position where said stop lug disengages from said stop slot; said treadmill further comprises a switch and a draw cord, said switch being mounted on said base and having a switch body and a control draw link pivotably mounted on said switch body, said draw cord having a cord sleeve and a cord body inserted into said cord sleeve and extending out of two ends of said sleeve respectively at two ends thereof, said cord sleeve having two ends respectively connected with said switch body and said junction mount, said cord body being connected with said control draw link and said actuating portion; said biasing member is a compression spring, fitted onto said cord body, and positioned between said junction mount and said actuating portion of said locking member.

10. The treadmill as defined in claim 1, wherein the length of said sleeve is larger than total amount of displacement that said bar of said retractable member reciprocates.

* * * * *